US006640845B1

(12) United States Patent
Wegman et al.

(10) Patent No.: US 6,640,845 B1
(45) Date of Patent: Nov. 4, 2003

(54) TONER FILLING APPARATUS AND METHOD INCLUDING AN ANTI-DRIBBLING NOZZLE HAVING AIR DISCHARGE PORTS

(75) Inventors: Paul M. Wegman, Pittsford, NY (US); Mikhail Vaynshteyn, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/198,398

(22) Filed: Jul. 17, 2002

(51) Int. Cl.[7] ..... B65B 1/08

(52) U.S. Cl. ..... 141/67; 141/65; 141/90; 141/59; 141/89; 222/149

(58) Field of Search ..... 141/67, 65, 4, 141/5, 89, 90, 91, 92, 93, 115, 116, 192, 59, 62, 70, 144, 145; 222/148, 149, 226

(56) References Cited

U.S. PATENT DOCUMENTS 3,788,368 A * 1/1974 Geng et al. ..... 141/67
5,598,876 A * 2/1997 Zanini et al. ..... 141/90
6,102,088 A * 8/2000 Wegman ..... 141/286
6,340,036 B1 * 1/2002 Toyoizumi et al. ..... 141/67

FOREIGN PATENT DOCUMENTS

JP 404087903 A * 3/1992

* cited by examiner

*Primary Examiner*—Gregory L. Huson
*Assistant Examiner*—Khoa D Huynh
(74) *Attorney, Agent, or Firm*—Tallam I. Nguti

(57) ABSTRACT

A method and apparatus have been provided for directing toner from a hopper containing a supply of toner to fill as well as cleanly cutoff filling of a container without post-cutoff dribbling. The apparatus for the method includes (a) a conduit member connected to the hopper and having a discharging end for permitting a toner to be moved there-through; (b) a conveyor device located at least partially within the conduit member for moving the toner from the hopper in a toner moving direction towards the container; and (c) an anti-dribbling nozzle device for directing the toner from the conveyor to cleanly fill the container. The anti-dribbling nozzle device includes a source of pressurized air, a controller, and a nozzle member that has a first end connected to the discharge end of the conduit member, a second and opposite end for dispensing moving toner into the container, and a nozzle wall connecting the first end to the second thereof. The nozzle wall includes slanted air discharging ports for discharging directed pulses of positive pressure air to forcibly remove powder from the nozzle wall, thereby enabling clean cutoff of powder flowing into the container without post-cutoff dribbling.

5 Claims, 5 Drawing Sheets

TONER FILLING APPARATUS AND METHOD INCLUDING AN ANTI-DRIBBLING NOZZLE HAVING AIR DISCHARGE PORTS

RELATED APPLICATIONS

This application is related to U.S. application Ser. No. 10/197,921 entitled "TONER FILLING APPARATUS AND METHOD INCLUDING A NOZZLE HAVING POST-CUTOFF VIBRATOR ASSEMBLY" filed on the same date herewith, and having at least one common inventor.

BACKGROUND OF THE INVENTION

This invention relates generally to apparatus for filling a container with dry particulate material, and more particularly concerns a filling apparatus including an anti-dribbling filling nozzle having slanted air discharge ports for achieving dribble-free, clean-cutoff filling of a container with particulate materials such as toner.

Currently when filling particulate materials, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner/funnel friction.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube or nozzle required to fit into the small toner container opening and secondly for all the toner within the container to completely and cleanly fill the remote portions of the container before the container overflows.

In addition, during the filling operation there is some ordinarily undesirable continued discharge of toner (dribbling) from a conventional nozzle at cutoff or at the end of the filling cycle. In one embodiment, the end of a filling cycle occurs when the auger stops rotating and positive pressure normal to the axis of the auger is kept on for a fraction of a second longer in order to give some time for the toner or powder remaining in the nozzle to drop into the container. After that, the positive pressure is cut off and negative pressure in the form of a vacuum is turned on to "freeze" against the nozzle wall, any toner particles still remaining in the nozzle.

The main problem with this process is that when the positive pressure in the nozzle is switched to vacuum, this vacuum usually can firmly hold only a 3–5 mm thick layer of toner particles against the inner nozzle wall. Therefore in cases where the amount of toner remaining inside the nozzle is sufficient to create a layer thicker than 5 mm, the force of vacuum will be marginal (weak) for holding those toner particles on the top of the 5 mm layer surface. Thus, very often this force is not enough to hold them for more than 0.5–1 sec. Therefore, undesirable post-cutoff continued toner fallout or dribbling occurs when the filling apparatus indexes from one container to the next, thus resulting in dirty tops and/or sides of containers.

Conventional filling apparatus include conventional clean filling systems for use with such apparatus. Such a clean filling system is secured to filling line as well as to the toner conduit, and may be used to support a slide. The slide is connected to a tray or toner drip plate which slidably is fitted between the nozzle and the opening. A tray or drip plate in this position acts to prevent the spilling of powder during the indexing of containers. A housing which surrounds part of the nozzle, provides a cavity or chamber which is sealed when the tray or drip plate is in its closed position.

SUMMARY OF THE INVENTION

In accordance with the present invention, there is provided a method and apparatus for directing toner from a hopper containing a supply of toner to fill as well as cleanly cutoff filling of a container without post-cutoff dribbling. The apparatus includes (a) a conduit member connected to the hopper and having a discharging end for permitting a toner to be moved therethrough; (b) a conveyor device located at least partially within the conduit member for moving the toner from the hopper in a toner moving direction towards the container; and (c) an anti-dribbling nozzle device for directing the toner from the conveyor to cleanly fill the container. The anti-dribbling nozzle device includes a source of pressurized air, a controller, and a nozzle member that has a first end connected to the discharge end of the conduit member, a second and opposite end for dispensing moving toner into the container, and a nozzle wall connecting the first end to the second thereof. The nozzle wall includes slanted air discharging ports for discharging directed pulses of positive pressure air to forcibly remove powder from the nozzle wall, thereby enabling clean cutoff of powder flowing into the container without post-cutoff dribbling.

BRIEF DESCRIPTION OF THE DRAWINGS

In the detailed description of the invention presented below, reference is made to the drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
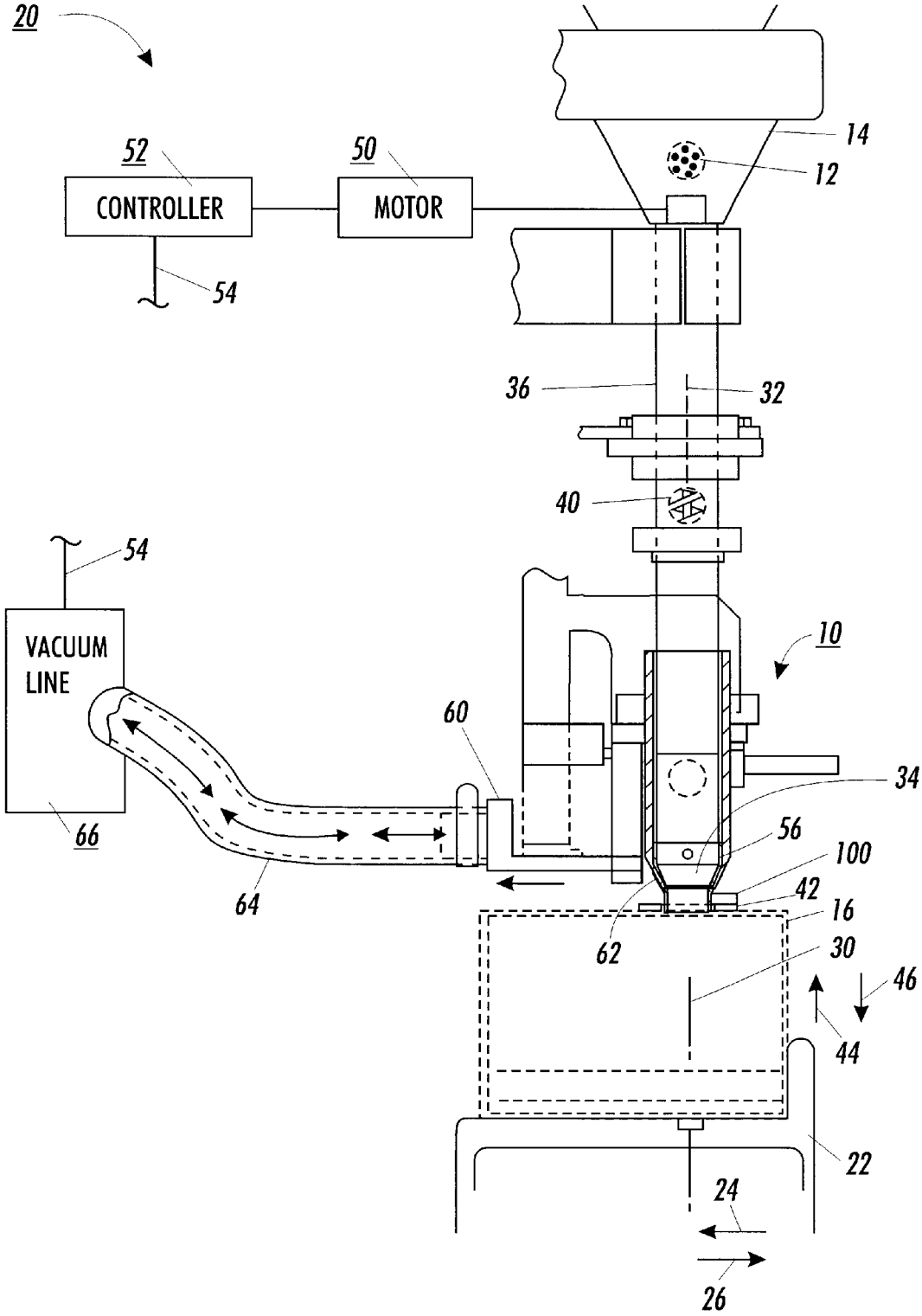
FIG. 1 is an elevational view of a toner container filling apparatus partially in section utilizing an anti-dribbling nozzle device having the slanted air discharge ports in accordance with the present invention.

According to the present invention and referring now to FIG. 1, powder filling apparatus 10 is shown. The powder filling apparatus 10 is used to convey powder 12 in the form of toner for use in a copier or printer from a hopper 14 to a container 16. The powder filling apparatus 10 is mounted to filling line 20 to permit for the filling of large production quantities of containers 16, the container 16 is mounted to a carrying device 22. The device 22 is movable in the direction of either arrow 24 or 26. The carrying device 22 serves to position container centerline 30 in alignment with apparatus centerline 32.

The powder filling apparatus 10 includes an anti-dribbling nozzle 34 (in accordance with the present invention, and to be described in detail below) which is used to direct the powder 12 into the container 16. The anti-dribbling nozzle 34 is connected to the hopper 14 by means of a conduit 36 in the form of a hollow tube or funnel. As shown in FIG. 1, the hopper 14 is positioned above the container 16 whereby gravity will assist in the flow of powder 12 toward the container 16. To optimize the flow of powder 12 toward the container 16, the powder filling apparatus 10 further includes a conveyor 40 positioned at least partially within the conduit 36 for assisting in the flow of the powder 12. The conveyor 40 is in the form of a spiral conveyor or auger. For example, the auger 40 may be in the form of a spiral shaped auger, which may include various geometries, such as, a straight or tapered helical screw. The auger closely conforms to the conduit.

The anti-dribbling nozzle 34 is insertable into opening 42 of the container 16. The insertion of the anti-dribbling nozzle 34 in the opening 42 may be accomplished in any suitable method. For example, the carrying device 22 and, consequently, the container 16 may be movable upward in the direction of arrow 44 for engagement with the anti-dribbling nozzle 34 and downward in the direction of arrow 46 for disengagement from the opening 42. The upward and downward motion of the device 22 and the container 16 permits the container 16 to be indexed in the direction of arrows 24 and 26.

To permit the filling of a number of containers 16, the flow of powder 12 from the hopper 14 must be halted by cutting off filling or powder flow, during the indexing of a filled container 16 from the fill position and during the indexing of the unfilled container 16 toward the filling position. In accordance with the present invention, it is important that halting powder flow by cutting off filling or powder flow be achieved cleanly without significant or any post-cutoff continued flow or dribbling.

Figure 3:
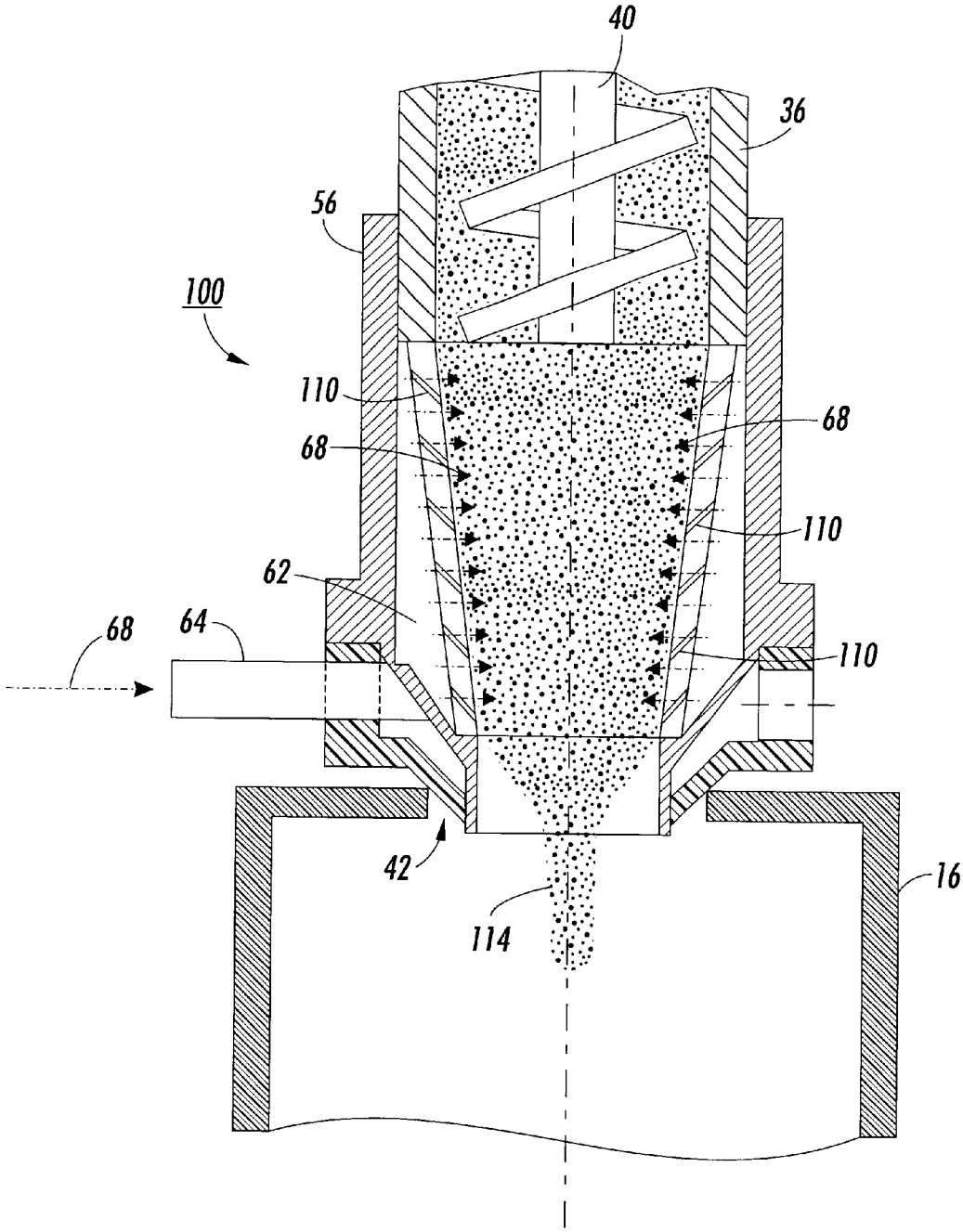
FIG. 3 is an elevational view of the anti-dribbling nozzle device of FIG. 2 during container filling.
Figure 4:
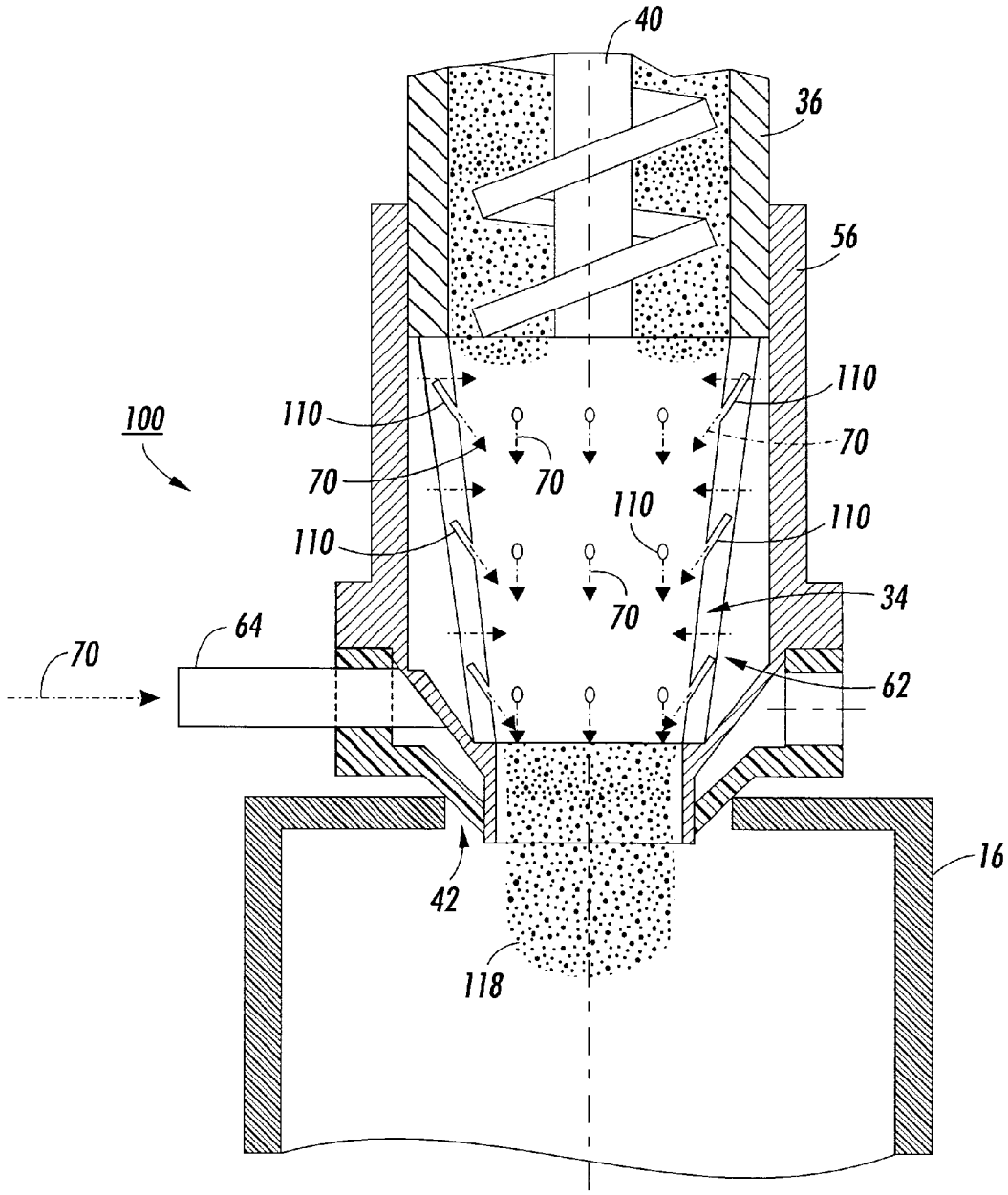
FIG. 4 is an elevational view of the anti-dribbling nozzle device of FIG. 2 during cutoff of container filling.
Figure 5:
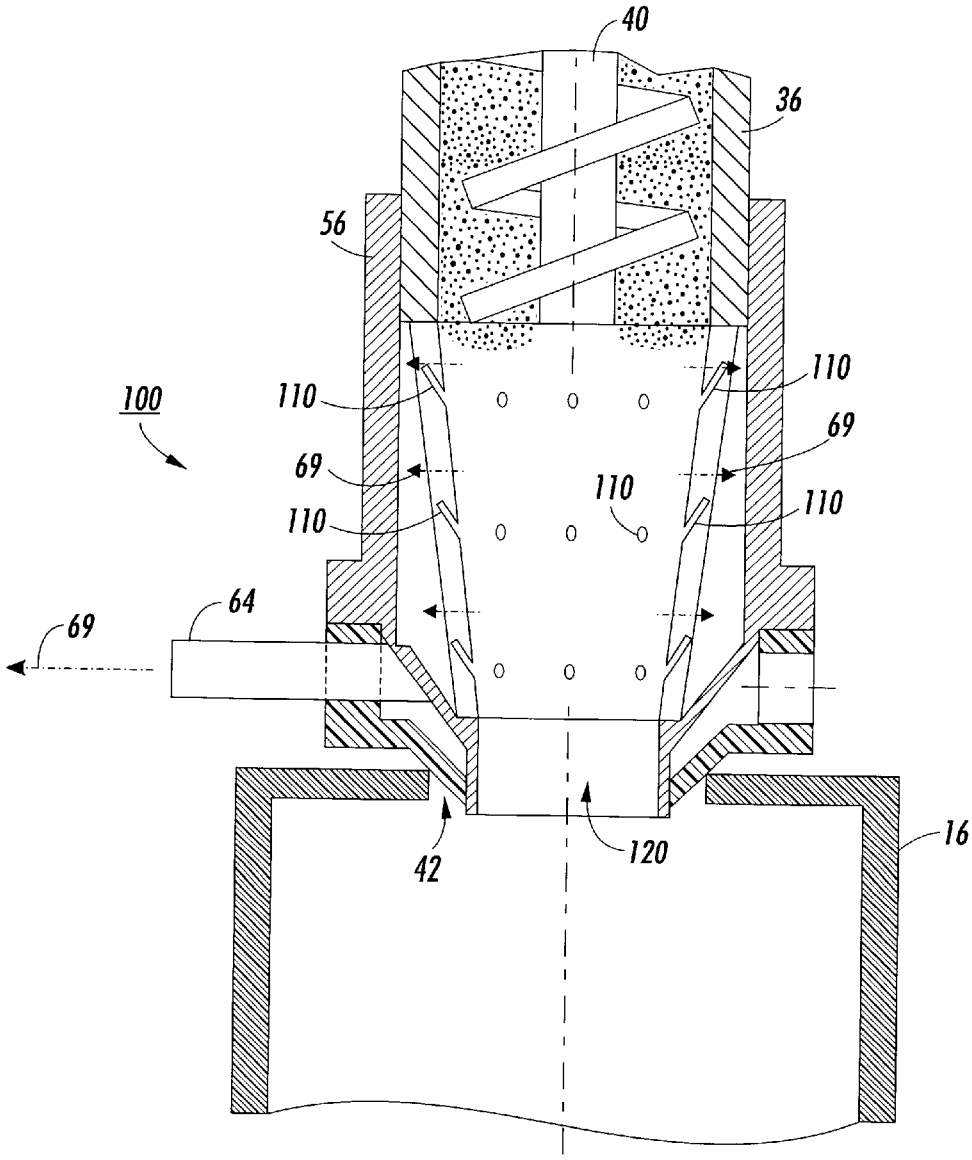
FIG. 5 is an elevational view of the anti-dribbling nozzle device of FIG. 2 post-cutoff showing a clean cutoff without dribbling in accordance with the present invention.

As shown in FIG. 1, the auger 40 may be rotated by any suitable method, i.e. by motor 50 connected to the auger 40 for rotating the auger 40 in a direction 53. The motor 50 is connected to a controller 52 which sends a signal to the motor 50 to stop the rotation of the auger 40 during indexing of the carrying device 22. The controller 52 is also connected by means 54 to the source 66 of pressurized air for varying the application of positive air pressure from a uniform pressure 68 to short bursts of higher pressure air 70. Accordingly, the primary flow of powder 12 is halted by the stopping of auger 40 within the conduit 36 and by the use of a valve therein (not shown). A housing 56 which surrounds part of the anti-dribbling nozzle 34, provides a cavity or chamber 62 which is sealed when the discharge opening 94 of the nozzle 34 is closed by suitable means (not shown). The chamber 62 can be pressurized or kept under vacuum via an air pressure applying device 64 that can apply uniform positive pressure 68 (FIGS. 2 and 3) as during a filling cycle, short bursts of higher positive pressure 70 for dribble-free cutoff in accordance with the present invention, or negative pressure 69 (FIGS. 4 and 5) post-cutoff. As shown in FIG. 1, the device 64 can also be a toner dust vacuum line 64 to an air pressure and vacuum source 66.

Figure 2:
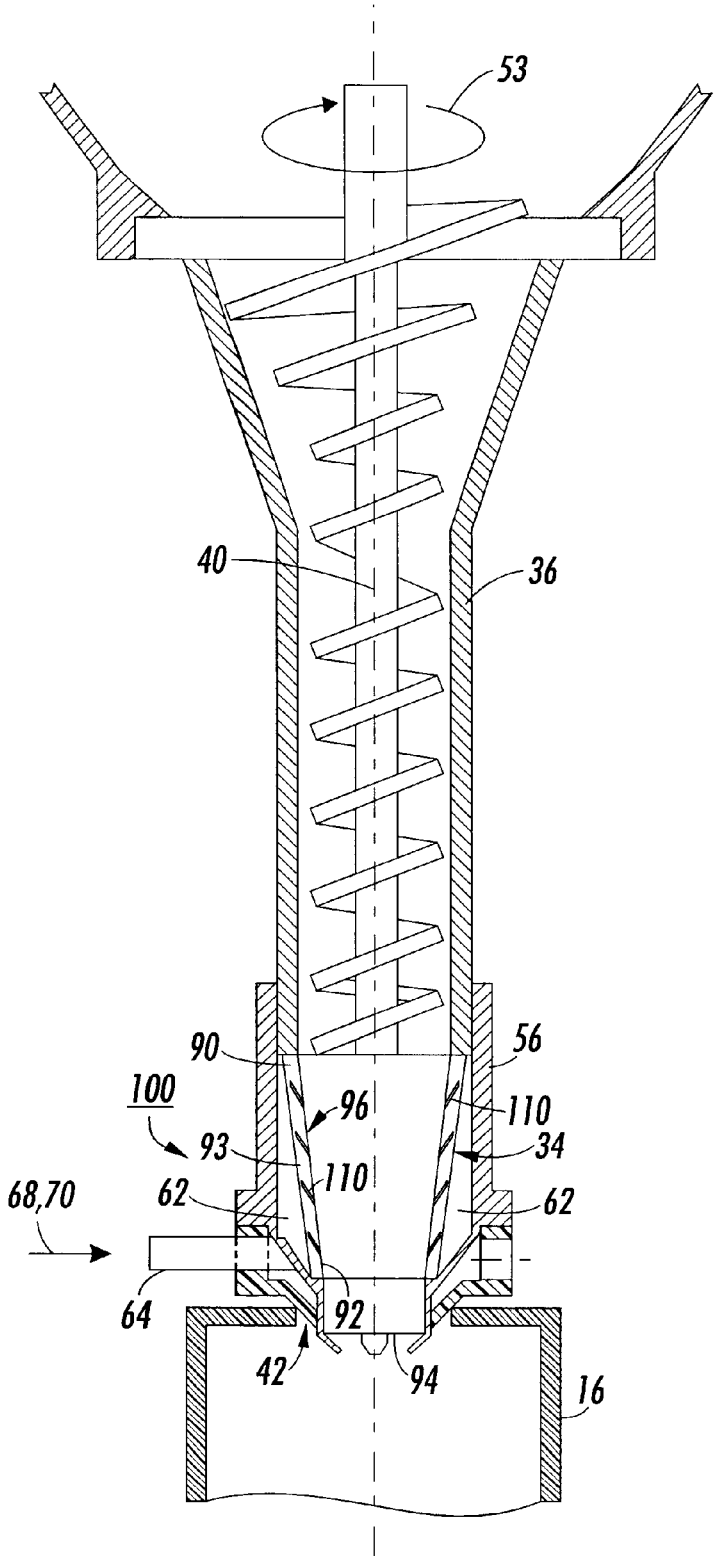
FIG. 2 is an elevational view of an enlarged portion of the filling apparatus of FIG. 1 showing the anti-dribbling nozzle device having the slanted air discharge ports in accordance with the present invention.

Referring now to FIGS. 1–2, the anti-dribbling nozzle 34 is shown in greater detail and includes a first end 90 adjacent to and mounted to the conduit 36, as well as a second end 92 opposed to the first end 90. The anti-dribbling nozzle 34 is comprised of a wall 96 and is secured to the conduit 36 in any suitable fashion. For example, as shown the first end 90 of the anti-dribbling nozzle 34 may be press fitted over the conduit 36 and is rigidly located within the housing 56. Between the first end 90 and the second end 92 of the anti-dribbling nozzle 34 is a central portion 93 of the nozzle. The central portion 93 has a hollow substantially conofrustrical shape or funnel like shape. As shown, the second or discharge end 92 includes a discharge opening 94 defined by the wall 96.

Thus to recap, in accordance with the present invention, there is disclosed an apparatus 10 for directing powder 12 from a hopper 14 containing a supply of powder to fill as well as cleanly cutoff filling of a container 16 without post-cutoff dribbling. The apparatus 10 includes (a) a conduit member 36 connected to the hopper and having a discharging end for permitting a quantity of powder to be moved therethrough; (b) a conveyor device 40 located at least partially within the conduit member for moving the quantity of powder from the hopper in a powder moving direction; and (c) an anti-dribbling nozzle assembly 100 for directing a quantity 114 of powder from the conveyor device to cleanly fill the container 16.

The anti-dribbling nozzle assembly 100 includes a source 64 of pressurized air, a controller 52 and a nozzle member 34 having a first end 90 connected to the discharge end of the conduit member 36, a second and opposite end 92 for dispensing moving powder into the container, and a nozzle wall 96 connecting the first end to the second end. The nozzle wall 96 includes slanted air discharge ports 110 for selectively discharging directed pulses 70 of positive pressure air to forcibly remove powder from the nozzle wall 96, thereby enabling clean cutoff of powder flowing into the container without post-cutoff dribbling. In one embodiment as shown, the nozzle wall 96 is porous to air so that uniform relatively lower pressure air can penetrate from the cavity 62 outside the wall 96 through random pores within the wall 96, and in a direction normal to the axis of the nozzle (FIG. 3) into the inside of the wall 96, thereby reducing friction between flowing powder or toner and the inside of the wall.

As further shown, the slanted air discharge ports 110 are located uniformly around the nozzle wall 96 and between the first end 90 and the second 92 thereof. The slanted air discharge ports 110 are each slanted forwardly relative to a direction of powder flow into the container. The slanted air discharge ports each form an angle of less than 15 degrees with the wall. The integration of the slanted or angled air discharge ports 110 into the body or wall 96 of the nozzle member 34 effectively provides an additional and timely force at the end of the cutoff cycle for pushing out the powder or toner 118 from the nozzle into the container 16.

Further, with the means 66, 64, for applying positive 68, 70 and negative 69 air pressure to the wall 96 of the nozzle member 34, the method of cleanly cutting off filling of the container without post-cutoff dribbling of powder in accordance with the present invention includes (a) stopping rotation of the auger 40 for moving powder material from the hopper, and stopping application of uniform continuous positive pressure 68 to the wall 96 of the nozzle member 34; (b) applying negative pressure 69 to the wall 96; (c) next applying increased short bursts 70 of positive air pressure through the slanted air discharge ports 110 in the wall for forcibly removing any powder from the nozzle wall; and (c)

finally applying negative air pressure 69 again to the wall 96 following the step of applying increased short bursts 70 of positive air pressure. This thereby enables cleanly cutting off filling of the container 16 without post-cutoff dribbling of powder.

As can be seen, there has been provided a method and apparatus have been provided for directing toner from a hopper containing a supply of toner to fill as well as cleanly cutoff filling of a container without post-cutoff dribbling. The apparatus includes (a) a conduit member connected to the hopper and having a discharging end for permitting a toner to be moved therethrough; (b) a conveyor device located at least partially within the conduit member for moving the toner from the hopper in a toner moving direction towards the container; and (c) an anti-dribbling nozzle device for directing the toner from the conveyor to cleanly fill the container. The anti-dribbling nozzle device includes a source of pressurized air, a controller, and a nozzle member that has a first end connected to the discharge end of the conduit member, a second and opposite end for dispensing moving toner into the container, and a nozzle wall connecting the first end to the second thereof. The nozzle wall includes slanted air discharging ports for discharging directed pulses of positive pressure air to forcibly remove powder from the nozzle wall, thereby enabling clean cutoff of powder flowing into the container without post-cutoff dribbling.

While the embodiment disclosed herein is preferred, it will be appreciated from this teaching that various alternative, modifications, variations or improvements therein may be made by those skilled in the art, which are intended to be encompassed by the following claims

We claim:

1. In a powder filling apparatus including a hopper, a rotatable auger for moving powder material from said hopper towards a container to be filled, anti-dribbling nozzle device including a nozzle member for inserting into the container, and means for applying positive and negative air pressure to a wall of said nozzle member, a method of cleanly cutting off filling of the container from a filling cycle without post-cutoff dribbling of powder, the method comprising:

(a) stopping rotation of said auger for moving powder material from said hopper, and application of uniform continuous positive pressure to said wall of said anti-dribbling nozzle;

(b) applying negative pressure to said wall of said anti-dribbling nozzle device;

(c) applying increased short bursts of positive air pressure through slanted air discharge ports in said wall for forcibly removing any powder from the nozzle wall; and (d) applying negative pressure again to said wall of said anti-dribbling nozzle device following said step of applying increased short bursts of positive air pressure, thereby enabling cleanly cutting off filling of the container without post-cutoff dribbling of powder.

2. The method of claim 1, wherein said nozzle wall is porous to air.

3. The method of claim 1, wherein said slanted air discharge ports are located uniformly around said nozzle member and between said first end and said second thereof.

4. The method of claim 3, wherein said slanted air discharge ports are each slanted forwardly relative to a direction of powder flow into the container.

5. The method of claim 4, wherein said slanted air discharge ports each form an angle of less than 15 degrees with said wall.

* * * * *